US011585235B2

(12) United States Patent
Unton

(10) Patent No.: US 11,585,235 B2
(45) Date of Patent: Feb. 21, 2023

(54) MAGNETIC SHAFT MODE CONTROL

(71) Applicant: Rolls-Royce North American Technologies Inc., Indianapolis, IN (US)

(72) Inventor: Timothy Unton, Avon, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 160 days.

(21) Appl. No.: 16/951,569

(22) Filed: Nov. 18, 2020

(65) Prior Publication Data

US 2022/0154597 A1 May 19, 2022

(51) Int. Cl.
*F01D 25/04* (2006.01)
*F01D 5/02* (2006.01)

(52) U.S. Cl.
CPC ..... *F01D 25/04* (2013.01); *F01D 5/026* (2013.01); *F05D 2220/32* (2013.01); *F05D 2240/60* (2013.01); *F05D 2270/00* (2013.01)

(58) Field of Classification Search
CPC ..... B01D 2257/504; B01D 2259/65; B01D 53/002; F01D 15/10; F01D 25/305; F01D 11/14; F01D 25/04; F01D 5/026; F01D 25/164; F01K 23/10; F01K 7/38; F05D 2270/08; F05D 2220/32; F05D 2240/60; F05D 2270/00; Y02C 20/40; Y02E 20/32; F04D 29/058; F04D 29/059; F04D 29/668; F16F 15/005; F16C 39/06; F16C 2360/23
See application file for complete search history.

(56) References Cited

U.S. PATENT DOCUMENTS

| | | | | |
|---|---|---|---|---|
| 4,141,604 | A * | 2/1979 | Habermann | F16C 32/0402 310/90.5 |
| 4,626,754 | A | 12/1986 | Habermann et al. | |
| 4,999,534 | A | 3/1991 | Andrianos | |
| 5,053,662 | A | 10/1991 | Richter | |
| 5,142,177 | A | 8/1992 | Higuchi et al. | |
| 5,347,190 | A | 9/1994 | Lewis et al. | |
| 5,658,125 | A * | 8/1997 | Burns | F04D 29/058 415/70 |
| 5,867,979 | A * | 2/1999 | Newton | F02C 3/113 310/90.5 |
| 6,249,070 | B1 * | 6/2001 | Sharp | B60R 16/027 310/90.5 |
| 6,720,695 | B2 | 4/2004 | Coenen | |
| 6,881,027 | B2 * | 4/2005 | Klaass | F16C 17/024 415/230 |
| 7,836,601 | B2 | 11/2010 | El-Shafei | |
| 10,337,557 | B1 * | 7/2019 | McMullen | H02K 7/09 |
| 10,550,910 | B2 | 2/2020 | Glanzner | |
| 2003/0127927 | A1 * | 7/2003 | Razzell | F16C 32/044 310/90.5 |
| 2022/0154597 | A1 * | 5/2022 | Unton | F01D 25/04 |

FOREIGN PATENT DOCUMENTS

| | | |
|---|---|---|
| EP | 612933 | 8/1994 |
| JP | 6173948 | 9/2015 |

* cited by examiner

*Primary Examiner* — Jesse S Bogue
(74) *Attorney, Agent, or Firm* — Barnes & Thornburg LLP

(57) ABSTRACT

A shaft assembly for use with a turbine engine includes a shaft and a magnetic mode control unit. The shaft extends along an axis and is configured to rotate about the axis. The magnetic mode control unit is configured to control deflection of the shaft as the shaft rotates about the axis.

15 Claims, 5 Drawing Sheets

MAGNETIC SHAFT MODE CONTROL

FIELD OF THE DISCLOSURE

The present disclosure relates generally to gas turbine engines, and more specifically to shaft damping systems for use in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high-pressure air to the combustor. In the combustor, fuel is mixed with the high-pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

The fan and compressor may be interconnected to the turbine with rotating shafts that transfer power and torque produced by the turbine to the fan and compressor. The rotating shafts are supported by bearings and have unsupported regions along the shaft that vibrate at varying frequencies associated with the rotational speed of the shafts. It may be desired to develop systems to dampen such vibrations.

SUMMARY

The present disclosure may comprise one or more of the following features and combinations thereof.

A shaft assembly may include a first shaft, a second shaft, and a magnetic mode control unit. The first shaft unit may include a first shaft, a first forward bearing, and a first aft bearing. The first shaft may extend along an axis and be configured to rotate about the axis. The first forward bearing may be configured to support the first shaft. The first aft bearing may be configured to support the first shaft and be spaced apart axially from the first forward bearing relative to the axis. The second shaft unit may include a second shaft, a second forward bearing, and a second aft bearing. The second shaft may be arranged circumferentially about the first shaft and configured to rotate about the axis relative to the first shaft. The second forward bearing may be configured to support the second shaft. The second aft bearing may be configured to support the second shaft and spaced apart axially from the second forward bearing relative to the axis.

The magnetic mode control unit may include a first magnet and a second magnet. The magnetic mode control unit may be configured to control deflection of the first shaft caused by natural frequency vibration of the first shaft during rotation of the first shaft. The first magnet may be coupled with the first shaft for rotation therewith. The first magnet may be located axially between the first forward bearing and the first aft bearing. The second magnet may be located radially outward of the first shaft and aligned axially with the first magnet. The second magnet may apply a magnetic force to the first magnet during rotation of the first shaft and may reduce deflection of the first shaft.

In some embodiments, the first magnet may located axially at an anti-node of a first order vibrational mode of the first shaft. In another embodiment, the first magnet may be located axially at an anti-node of a second order vibrational mode of the first shaft.

In other embodiments, the second magnet may be located radially outward of the second shaft. In some embodiments, the second shaft may be made of non-ferritic material so that the second magnet may be configured to apply the magnetic force to the first shaft without applying the magnetic force to the second shaft. In another embodiment, the second magnet may be coupled with the second shaft for rotation therewith.

In a further embodiment, the second magnet may be an electromagnet. In other embodiments, the magnetic mode control unit may include a controller. The controller may be connected with the electromagnet and configured to power the electromagnet in response to the first shaft rotating at a speed greater than a first threshold value. In another embodiment, the controller may be configured to block power to the electromagnet in response to the first shaft rotating at a speed greater than a second threshold value.

According to another aspect of the present disclosure, a shaft assembly may include a first shaft unit and a magnetic mode control unit. The first shaft unit may include a first shaft, a first forward bearing, and a first aft bearing. The first shaft may extend along an axis and be configured to rotate about the axis. The first forward bearing may be configured to support the first shaft. The first aft bearing may be spaced apart axially from the first forward bearing relative to the axis and be configured to support the first shaft.

The magnetic mode control unit may include a first magnet located radially outward of the first shaft. The first magnet may be located axially between the first forward bearing and the second forward bearing. The magnetic mode control unit may be configured to apply a magnetic force to the first shaft.

In some embodiments, the first shaft may be made from Ferris material. In another embodiment, the first shaft may include a permanent magnet or an electromagnet axially aligned with the first magnet. In other embodiments, the first magnet may be an electromagnet. In further embodiments, the magnetic mode control unit may include a controller connected with the first magnet. The controller may be configured to supply power to the first magnet in response to the first shaft rotating at a speed greater than a first threshold value.

In another embodiment, the shaft assembly may include a second shaft unit. The second shaft unit may include a second shaft, a second forward bearing, and a second aft bearing. The second shaft may be arranged circumferentially about the first shaft and configured to rotate about the axis relative to the first shaft. The second forward bearing may be configured to support the second shaft. The second aft bearing may be configured to support the second shaft and be spaced apart axially from the second forward bearing relative to the axis.

In some embodiments, the first magnet may be located radially outward of the second shaft. In other embodiments, the first magnet may be coupled with the second shaft for rotation therewith.

According to another aspect of the present disclosure, a method of operating a shaft assembly may include the steps of arranging a first shaft radially inward of a second shaft, the first and second shafts may extend along an axis and rotate around the axis. The method may further include the steps of arranging a magnetic mode control unit radially outward of the first shaft, rotating the first shaft at a first speed that corresponds to a first mode of the first shaft, energizing the magnetic mode control unit to exert forces on the first shaft to reduce radial deflections of the first shaft, rotating the first shaft at a second speed higher than the first speed, and configuring the magnetic mode control unit to de-engerize in response to the first shaft rotating at the second speed.

In some embodiments, the first shaft may include magnets coupled therewith and located at an anti-node location along the first shaft. In another embodiment, the first shaft may be made from ferrous material and the second shaft may be made from non-ferrous material. In other embodiments, the magnetic mode control unit may axially align to the anti-node locations along the axial length of the first shaft.

These and other features of the present disclosure will become more apparent from the following description of the illustrative embodiments.

DETAILED DESCRIPTION OF THE DRAWINGS

Figure 1:
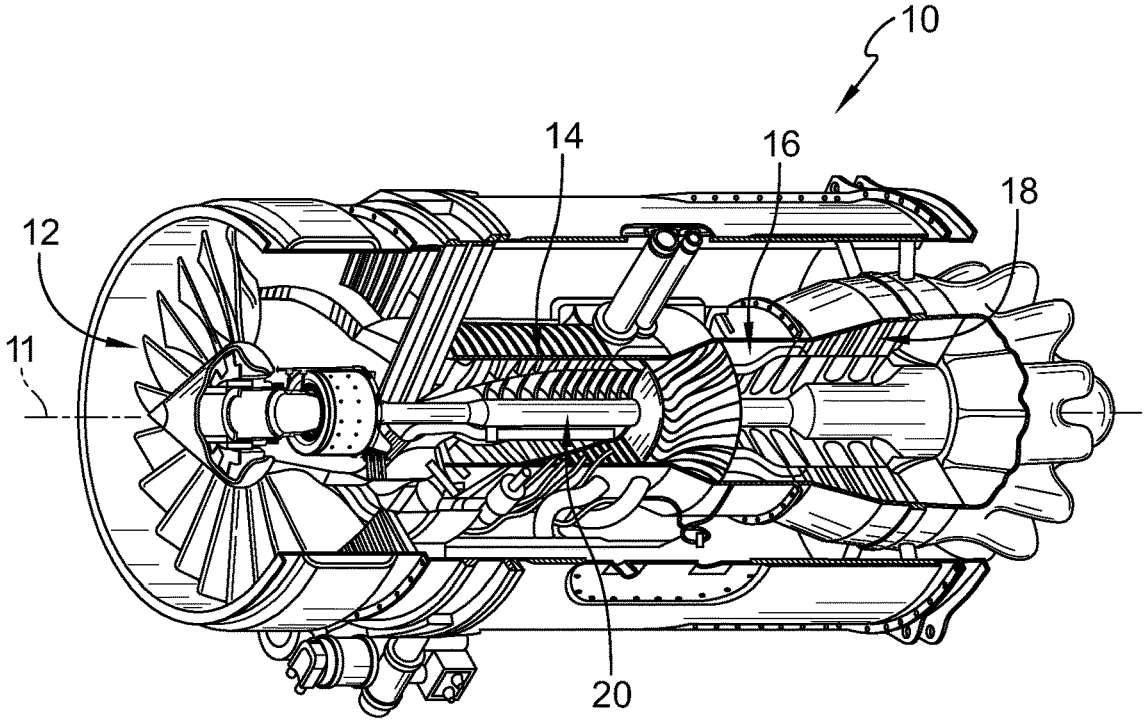
FIG. 1 is a cutaway perspective view of a gas turbine engine that includes a fan, a compressor, a combustor, a turbine, and a shaft assembly that includes a plurality of shafts that interconnect the turbine with the compressor and fan to transfer torque and power therebetween and a magnetic mode control unit configured to dampen deflection of at least one of the plurality of shafts.

For the purposes of promoting an understanding of the principles of the disclosure, reference will now be made to a number of illustrative embodiments illustrated in the drawings and specific language will be used to describe the same.

Figure 2:
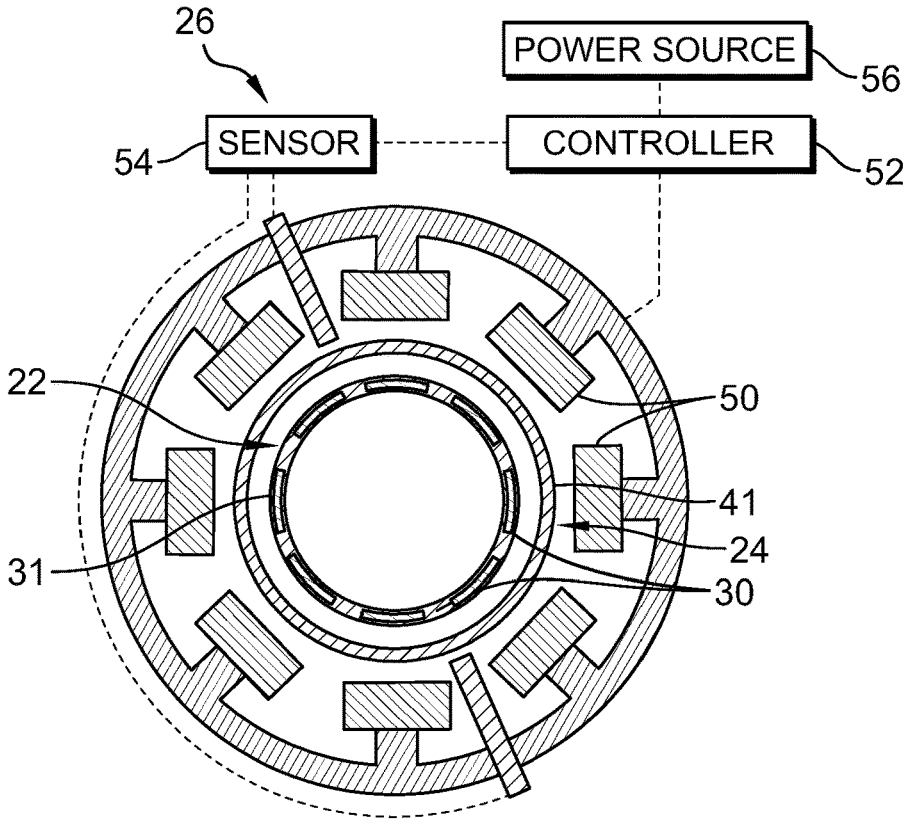
FIG. 2 is a cross-sectional forward view of a portion of the gas turbine engine of FIG. 1 showing an inner shaft and an outer shaft included in the plurality of shafts that rotate independently around an axis, and the magnetic mode control unit located radially outward of the shafts and connected with a controller and a power source for activating the magnetic mode control unit.

An illustrative aerospace gas turbine engine 10 includes a fan 12, a compressor 14, a combustor 16, a turbine 18, and a shaft assembly 20 as shown in FIG. 1. The turbine 18 is interconnected to the fan 12 and the compressor 14 by the shaft assembly 20. The shaft assembly 20 includes a first shaft 31 and a second shaft 41 that are concentric such that the first shaft 31 is radially inward of the second shaft 41 as shown in FIG. 2. The shaft assembly 20 further includes a magnetic mode control unit 26 with portions located radially outward of the second shaft 41 and axially aligned to an unsupported region 35 of the first shaft 31. The magnetic mode control unit 26 includes a plurality of magnets 30 coupled to the first shaft 31 at the unsupported region 35 of the first shaft 31.

The first shaft 31 has varying rotational speed through the engine cycle of the gas turbine engine 10 causing the first shaft 31 to vibrate at different frequencies. When the first shaft 31 rotates at a first mode speed, the frequency is equal to or about equal to the natural frequency for the first mode of the first shaft 31, causing the first shaft 31 to have maximum radial deflections at the anti-node 36 along the first shaft 31. In response to rotation at or near the first mode speed, the magnetic mode control unit 26 is energized to exert a magnetic force against the plurality of magnets 30 that are coupled to the first shaft 31 to suppress the radial deflections and dampen the vibrations of the first shaft 31. When the first shaft 31 is not at the first mode speed (or optionally in any other mode speed) the magnetic mode control unit 26 can be de-energized by a controller to reduce power consumption. In other embodiments, the magnetic mode control unit 26 may be energized at all times during use of the gas turbine engine.

Figure 3:
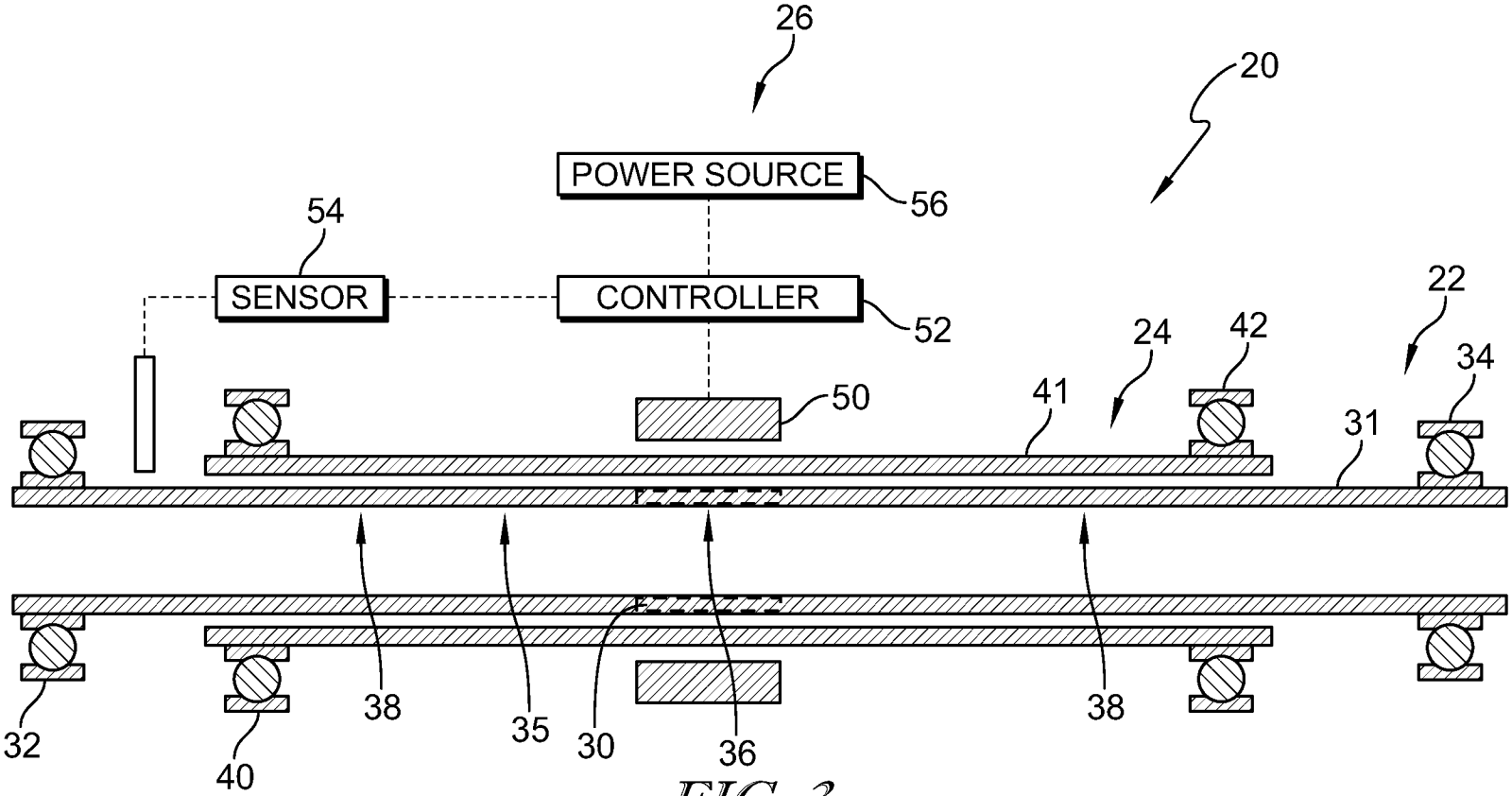
FIG. 3 is a cross-sectional side view of a portion of the gas turbine engine of FIG. 2 showing that each of the inner shaft and the outer shaft are supported by bearings at opposite ends of the respective shafts, and the magnetic mode control unit is positioned axially along the shafts adjacent to an unsupported region of the shafts.

The shaft assembly 20 transfers torque and power from the turbine 18 to the fan 12 and compressor 14 and includes the first shaft unit 22, the second shaft unit 24, and the magnetic mode control unit 26 as shown in FIGS. 2 and 3. The magnetic mode control unit 26 is statically fixed relative to the axis 11 to structure of the gas turbine engine 10. The first shaft unit 22 is located radially inward of the second shaft unit 24. The first shaft unit 22 and the second shaft unit 24 may rotate in the same direction around the axis 11 or in opposite directions around the axis 11.

The first shaft unit 22 includes a first shaft 31, a forward bearing 32, and an aft bearing 34 as shown in FIG. 3. The first shaft 31 extends along and rotates around the axis 11. The forward bearing 32 supports a forward end of the first shaft 31, and the aft bearing 34 supports an aft end of the first shaft 31. The unsupported region 35 of the first shaft 31 is located axially between the forward bearing 32 and the aft bearing 34. The forward and aft bearings 32, 34 may be ball bearings, roller bearings, tapered roller bearings, journal bearings, magnetic bearings, or other types of commonly used bearings.

Figure 4:
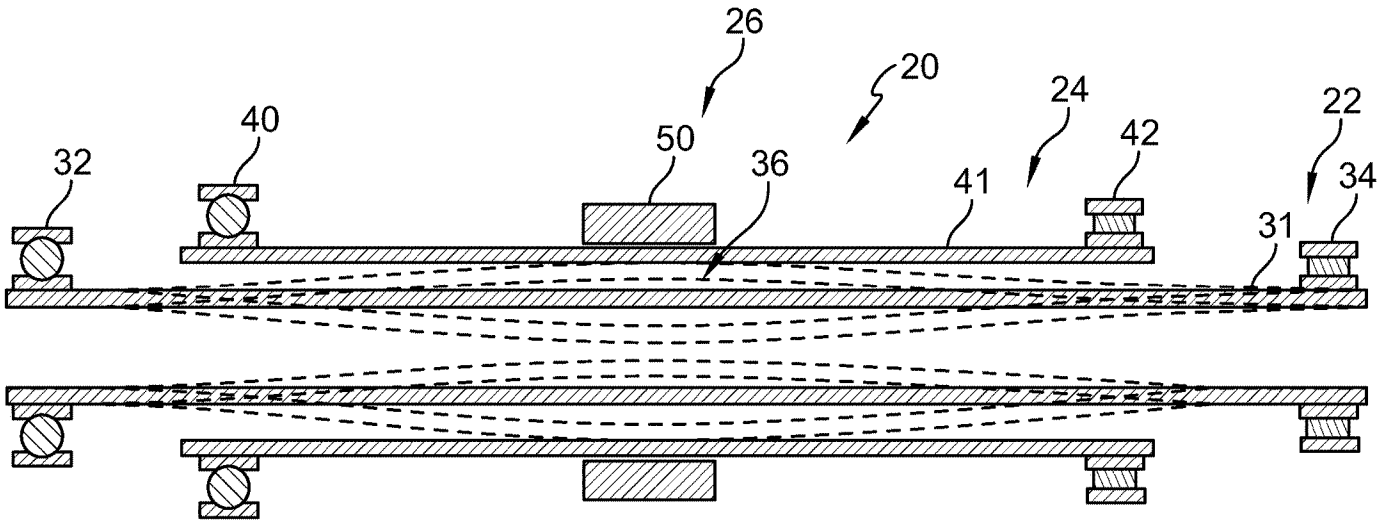
FIG. 4 is a diagrammatic view of the gas turbine engine of FIG. 3 showing first mode deflections of the inner shaft in dotted lines which have a maximum deflection at an anti-node between the bearings in response to the shaft rotating at a first mode speed, and the magnetic shaft control unit is axially aligned with anti-node location and configured to dampen the deflection of the inner shaft.
Figure 5:
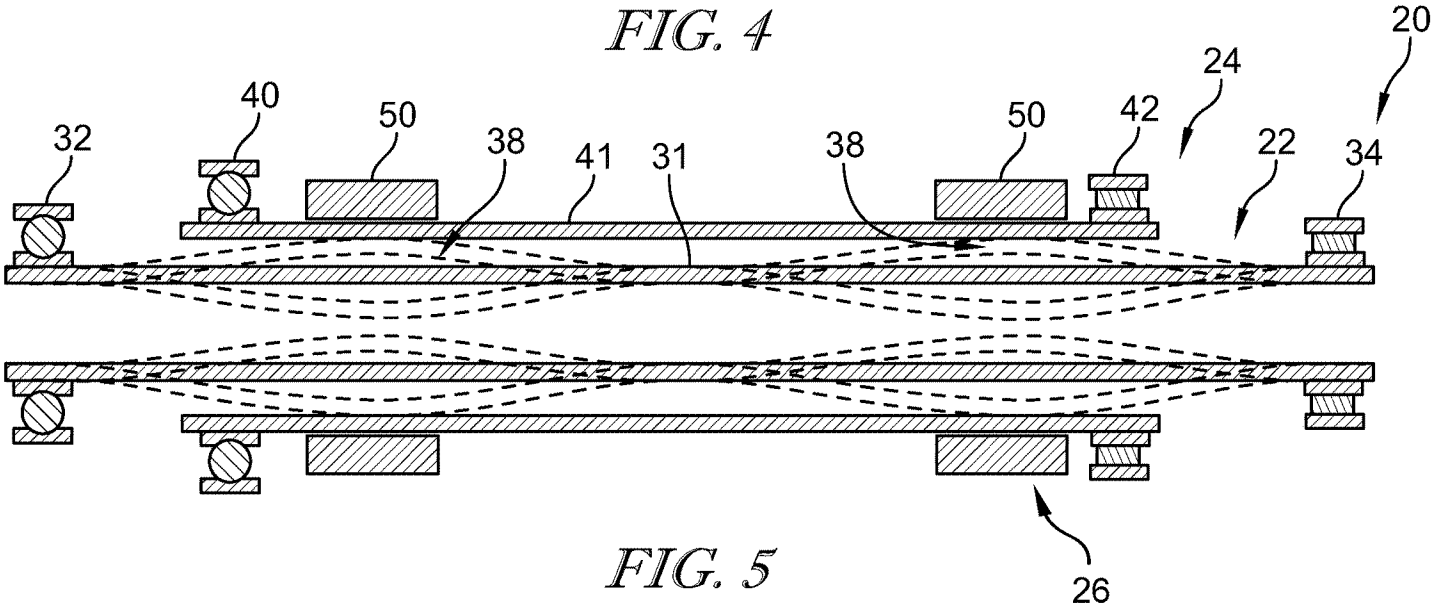
FIG. 5 is a diagrammatic view of another magnetic mode control unit adapted for use with the gas turbine engine of FIG. 3 showing the inner shaft rotating at a second speed that excites the second mode of the inner shaft, and the magnetic mode control unit includes and a forward unit and an aft unit that are each aligned axially with anti-nodes of the second mode.

During engine running, the first shaft 31 rotates at a variety of speeds. Frequencies are generated in the first shaft 31 at different rotational speeds. At the first mode speed, the frequencies generated are equal to or about equal to the natural frequency for the first mode of the first shaft 31 as shown in FIG. 4. The first shaft 31 may have its greatest radial deflections at the anti-node 36 for the first mode. The anti-node 36 is located midway between the front and aft bearings 32, 34 in the unsupported region 35 in the illustrative embodiment. The first shaft 31 can be rotated above the first mode speed to speeds where the frequencies generated no longer correspond to a natural frequency of the first mode of the first shaft 31. At speeds greater than the first mode speed and less than a second mode speed, the vibrations in the first shaft may be less severe and the load in the first shaft 31 may be reduced. The second mode speed, which is faster than the first mode speed, generates frequencies that correspond to the natural frequency for the second mode of the first shaft 31 as shown in FIG. 5. At the second mode speed, the first shaft 31 has two anti-nodes 38 along the axial length with greatest radial deflections.

The second shaft unit 24 includes a second shaft 41, a forward bearing 40, and an aft bearing 42 that rigidly support the ends of the second shaft 41 as shown in FIG. 3. The second shaft 41 is located radially outward of the first shaft 31 and radially inward of the second magnet 50 and controller 52 of the magnetic mode control unit 26. The second shaft 41 may be made from composite material or non-ferromagnetic material. The forward and aft bearings 40, 42 may be ball bearings, roller bearings, tapered roller bearings, journal bearings, magnetic bearings, or other types of commonly used bearings.

Each of the first shaft 31 and the second shaft 41 are coupled to different sections of the engine. For example, the first shaft 31 may interconnect a low-pressure turbine and the fan 12, and the second shaft 41 may interconnect a high-pressure turbine and the compressor 14. Other arrangements may be possible to interconnect between anyone of the low-pressure turbine, an intermediate-pressure turbine, or the high-pressure turbine, with anyone of an intermediate-pressure compressor, a high-pressure compressor, or the fan 12.

The magnetic mode control unit 26 exerts a magnetic force on the first shaft 31 to suppress radial deflections and dampen vibrations created when the first shaft 31 rotates at the first mode speed. The magnetic mode control unit 26 includes a first magnet 30, a second magnet 50, a controller 52, a sensor 54, and a power source 56 as shown in FIG. 2. The second magnet 50, the controller 52, the sensor 54, and the power source 56 are statically coupled to the gas turbine engine 10. In the illustrative embodiment in FIG. 2, the second magnet 50 is an electro-magnet and is coupled to the controller 52. The sensors 54 are positioned axially forward or aft of the second shaft unit 24 and radially outward and adjacent to the first shaft 31 as shown in FIG. 3. The sensors 54 detect vibration and radial deflection of the first shaft 31 and relay the data to the controller 52.

The first magnet 30 is coupled to the first shaft 31 along a portion of the unsupported region 35. In the illustrative embodiment in FIG. 2, the first magnet 30 includes a plurality of magnets embedded in the first shaft 31 and circumferentially spaced apart around the axis 11. The plurality of magnet 30 may be embedded in pockets formed on the inner or outer diameter of the first shaft 31. In some embodiments, the first magnet 30 may be a magnetic ring that is pressfit to the inner diameter or outer diameter of the first shaft 31. In another embodiment, the first shaft 31 may be made from composite material that is woven around the first magnet 30 to integrate the magnets within the first shaft 31. In further embodiments, the first shaft 31 may include flange features that the first magnet 30 may be coupled to.

In the illustrative embodiment in FIG. 3, the first magnet 30 is located at the anti-node 36 for the first mode of the first shaft 31. In another embodiment, the first magnet 30 may be located at the anti-nodes 38 for the second mode of the first shaft 31. In a further embodiment, the first magnet 30 may be located at a location of the unsupported region 35 that is axially between the anti-node 36 and anti-nodes 38. In other embodiments, the first magnet 30 may be located along the axial length of the unsupported region 35 that is not an anti-node for any mode shape of the first shaft 31 but experiences radial deflections at that location.

In some embodiments, the first shaft 31 may be made from ferromagnetic material to replace the first magnet 30. In another embodiment, the first shaft 31 may be a hybrid shaft that includes an axial portion that is made from ferromagnetic material located between axial portions that are made from non-ferromagnetic material.

The second magnet 50 is located radially outward and spaced apart from the first and second shaft 31, 41. In the illustrative embodiment in FIG. 2, the second magnet 50 includes a plurality of electro-magnets that are circumferentially spaced apart around the axis 11. The second magnet 50 is statically coupled to the gas turbine engine 10 and electrically coupled to the controller 52. In the illustrative embodiment in FIGS. 3 and 4, the second magnet 50 is axially aligned with the first magnet 30 at the anti-node 36 of the first shaft 31. In the illustrative embodiment in FIG. 5, the second magnet 50 is axially aligned with the anti-nodes 38 for the second mode of the first shaft 31. In a further embodiment, the second magnet 50 may be located at a location of the unsupported region 35 that is axially between the anti-node 36 and anti-nodes 38.

The controller 52 is electrically coupled to the sensor 54 and the second magnet 50, and is powered by the power source 56. The controller 52 receives inputs from the sensor 54 to determine the frequency of the first shaft 31 vibrations and/or the radial deflections of the first shaft 31. The controller 52 may also receive inputs related to the rotational speed of the first shaft 31. In response to the data received regarding the first shaft 31, the controller 52 energizes the second magnet 50 so that the second magnet 50 exerts a magnetic force through the second shaft 41 and on to the first magnet 30 that is coupled to the first shaft 31. The force exerted by the second magnet 50 suppresses deflections and/or vibrations of the first shaft 31.

The controller 52 is configured to energize the second magnet 50 when the first shaft 31 is at a first threshold speed. The first threshold speed may be slower than the first mode speed of the first shaft 31. In another embodiment, the first threshold speed may be the same as the first mode speed of the first shaft 31. The controller 52 may also be configured to energize the second magnet 50 when the speed of the first shaft 31 corresponds to other threshold speeds that correspond to other natural frequencies and mode shapes of the first shaft 31.

In response to the first shaft 31 rotating at a second threshold speed greater than the first mode speed, the controller 52 is configured to stop energizing the second magnet 50. The controller 52 may also be configured to stop energizing the second magnet 50 in response to the first shaft 31 not rotating at a mode speed or in response to vibrations or deflections of the first shaft 31 detected by the sensor 54 that are lower than a predetermined value. This allows the magnetic mode control unit 26 to save energy by not providing power throughout the engine cycle.

The controller 52 may be configured to energize the second magnet 50 for a range of speeds between the first threshold speed and the second threshold speed that are a small amount slower than the first mode speed, to a small amount faster than the first mode speed. The controller 52 may be configured to vary the amount of power provided to the second magnet 50 as the speed of the first shaft 31 transitions in and out the range of speeds. In another embodiment, the controller 52 may be configured to energize the second magnet 50 when the speed of the first shaft 31 is not at a mode speed of the first shaft 31, but the vibrations or deflections in the first shaft 31 may cause damage to the first shaft 31 or the gas turbine engine 10.

Figure 6:
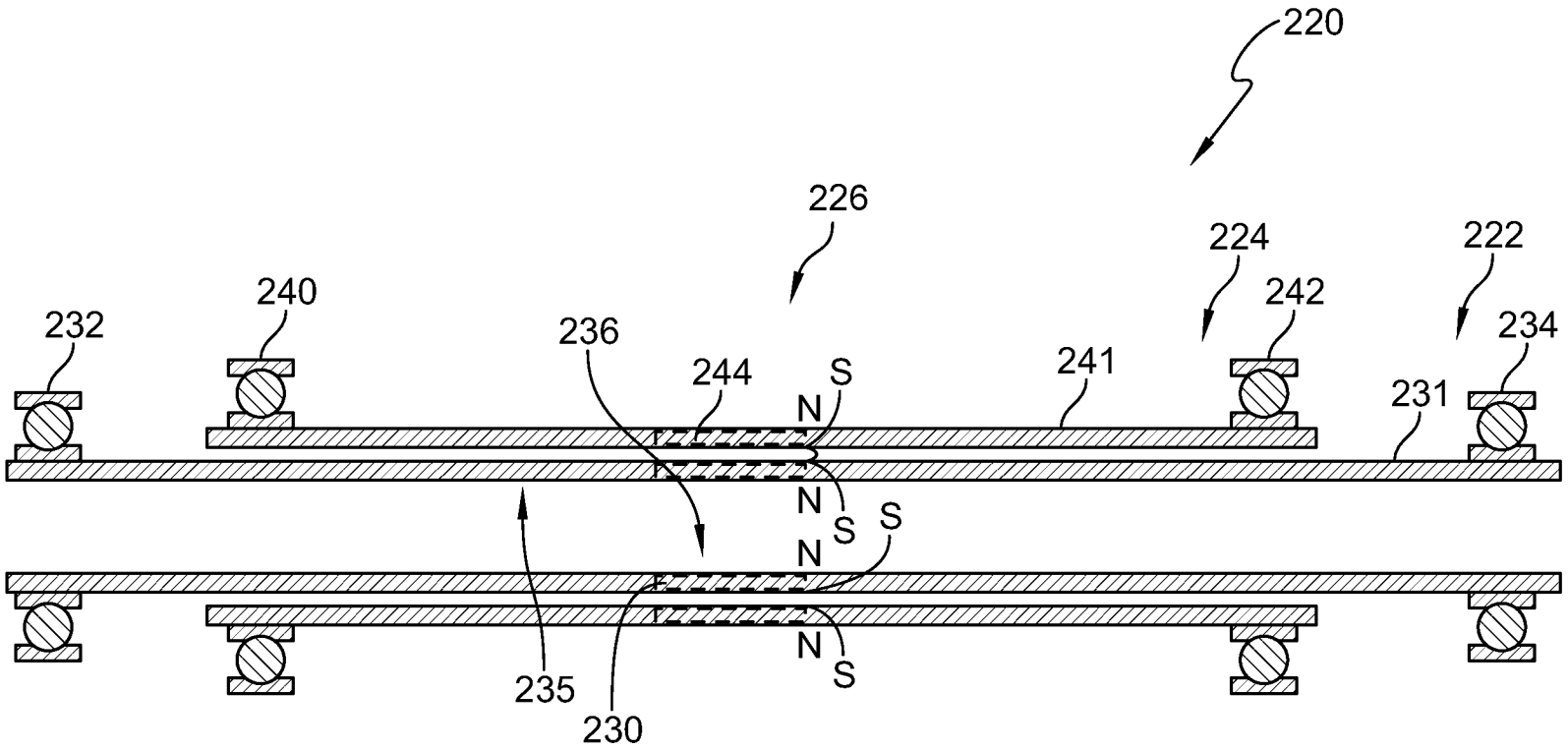
FIG. 6 is a cross-sectional side view of another shaft assembly adapted for use with the gas turbine engine of FIG. 1 showing the magnetic mode control unit includes an outer magnetic portion coupled with the outer shaft that is axially aligned and radially outward of an inner magnetic portion coupled with the inner shaft, and the polarity of the outer magnetic portion is arranged to be opposite the polarity of the inner magnetic portion so that the each magnetic portion repel one another.

Another embodiment of a shaft assembly 220 in accordance with the present disclosure is shown in FIG. 6. The shaft assembly 220 is substantially similar to the shaft assembly 20 shown in FIGS. 1-4 and described herein. Accordingly, similar reference numbers in the 200 series indicate features that are common between the shaft assembly 220 and the shaft assembly 20. The description of the shaft assembly 20 is incorporated by reference to apply to the shaft assembly 220, except in instances when it conflicts with the specific description and the drawings of the shaft assembly 220.

The shaft assembly 220 includes a first shaft unit 222, a second shaft unit 224, and a magnetic mode control unit 226 as shown in FIG. 6. The shaft assembly 220 uses a passive magnetic mode control system 226 to control vibrations and radial deflections in the first shaft unit 222. The first shaft unit 222 is located radially inward of the second shaft unit 224. The first shaft unit 222 and the second shaft unit 224 may rotate in the same direction around the axis 11 or in opposite directions around the axis 11.

The first shaft unit 222 includes a first shaft 231, a forward bearing 232, and an aft bearing 234 as shown in FIG. 6. The forward bearing 232 supports a forward end of the first shaft 231, and the aft bearing 234 supports an aft end of the first shaft 231. An unsupported region 235 of the first shaft 231 is located axially between the forward bearing 232 and the aft bearing 234.

The second shaft unit 224 includes a second shaft 241, a forward bearing 240, and an aft bearing 242 as shown in FIG. 6. The forward bearing 240 supports a forward end of the second shaft 224, and the aft bearing 242 supports an aft end of the second shaft 224.

The magnetic mode control unit 226 includes a first magnet 230 and a second magnet 244 as shown in the FIG. 6. The first magnet 230 is coupled to the first shaft 231 along a portion of the unsupported region 235. In the illustrative embodiment in FIG. 6, the first magnet 230 is embedded in the first shaft 231 and located at the anti-node 236 for the first mode of the first shaft 231. The second magnet 244 is coupled to the second shaft 241 so that the second magnet 244 and the first magnet 230 are axially aligned.

The first magnet 230 may be arranged so that the polarity of the first magnet 230 is opposite the polarity of the second magnet 244 when each of the first and second magnets 230, 244 are adjacent to each other in the shaft assembly 220. In the illustrative embodiment in FIG. 6, the north poles of each of the first and second magnets 230, 244 are arranged to face one another. In another embodiment, the south poles of each the first and second magnets 230, 244 may face one another. The arrangement of the polarities of each of the first and second magnets 230, 244 create a repelling force between the first and second magnets 230, 244.

In some embodiments, the second shaft 241 is configured to be stiffer than the first shaft 231 so that the second shaft 241 radially deflects less than the first shaft 231. The stiffer second shaft 241 passively suppresses radial deflections and vibrations in the first shaft 231 when the first shaft 231 rotates at the first mode speed. In a further embodiment, the second shaft 241 is configured to have natural frequencies at greater speeds than the first mode speed of the first shaft 231. This may allow for the second shaft 241 to have relatively smaller radial deflections and vibrations at the first mode speed than the first shaft 231 so that the second shaft 241 may passively suppress vibrations and deflections in the first shaft 231.

Figure 7:
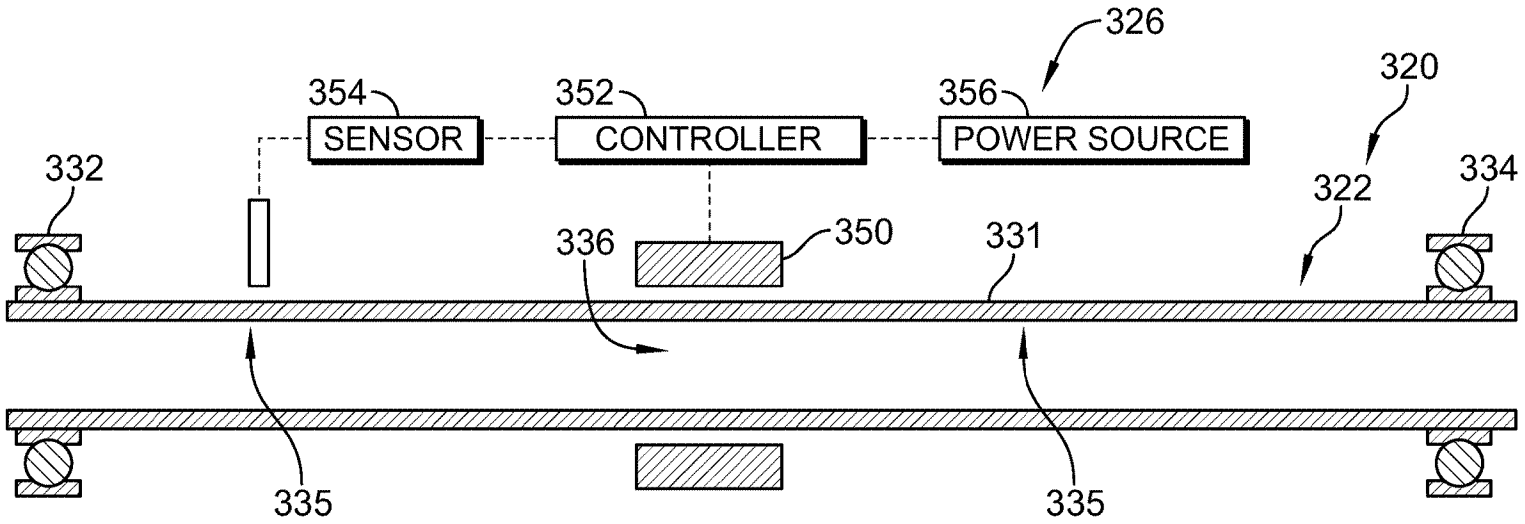
FIG. 7 is a cross-sectional side view of a shaft assembly adapted for use with the gas turbine engine of FIG. 1 showing a magnetic shaft control unit adjacent to a shaft that is coupled to a plurality of magnets, and the magnetic shaft control unit is energized to suppress radial deflections of the shaft in response to the shaft rotating at a first mode speed, and switched-off when the shaft is rotated at other speeds.

Another embodiment of a shaft assembly 320 in accordance with the present disclosure is shown in FIG. 7. The shaft assembly 320 is substantially similar to the shaft assembly 20 shown in FIGS. 1-4 and described herein. Accordingly, similar reference numbers in the 300 series indicate features that are common between the shaft assembly 320 and the shaft assembly 20. The description of the shaft assembly 20 is incorporated by reference to apply to the shaft assembly 320, except in instances when it conflicts with the specific description and the drawings of the shaft assembly 320.

The shaft assembly 320 includes a first shaft unit 322 and a magnetic mode control unit 326 as shown in FIG. 7. The first shaft unit 322 includes a first shaft 331, a forward bearing 332, and an aft bearing 334, and is made from ferromagnetic material. An unsupported region 335 of the first shaft 331 is located axially between the forward bearing 332 and the aft bearing 334.

The magnetic mode control unit 326 exerts a magnetic force on the first shaft 331 to suppress radial deflections and dampen vibrations created when the first shaft 331 rotates at the first mode speed. The magnetic mode control unit 326 includes a second magnet 350, a controller 352, a sensor 354, and a power source 356 as shown in FIG. 7. The magnetic mode control unit 326 is fixed relative to the axis 11 and statically coupled to the gas turbine engine 10. The sensors 354 are positioned axially forward or aft of the second magnet 350 and radially outward and adjacent to the first shaft 331.

The second magnet 350 is axially aligned with the anti-nodes 336 for the first mode of the first shaft 331. In a further embodiment, the second magnet 350 may be located at a location of the unsupported region 335 that is not aligned to an anti-node for any mode shape of the first shaft 331 but experiences radially deflections and vibrations.

In some embodiments, the magnetic mode control unit 326 may further include a first magnet 330 that is coupled to the first shaft 331 and axially aligned with the second magnet 350.

The controller 352 is electrically coupled to the sensor 354 and the second magnet 350, and is powered by the power source 356. The controller 352 receives inputs from the sensor 354 to determine the frequency of vibrations and/or the radial deflections of the first shaft 331. In response to the data received regarding the first shaft 331, the controller 352 energizes the second magnet 350 so that the second magnet 350 exerts a magnetic force on the first shaft 331. The force exerted by the second magnet 350 suppresses deflections and/or vibrations of the first shaft 331. In response to the first shaft 331 rotating below a first threshold value or above a second threshold value, the controller 352 is configured to stop energizing the control magnet 350. The controller 352 may also be configured to stop energizing the second magnet 350 in response to the first shaft 331 not rotating at a first mode speed or in response to deflections or vibrations of the first shaft 331, detected by the sensor 354, which are lower than a predetermined value. This allows the magnetic mode control unit 326 to save energy by not providing power throughout the engine cycle.

Figure 8:
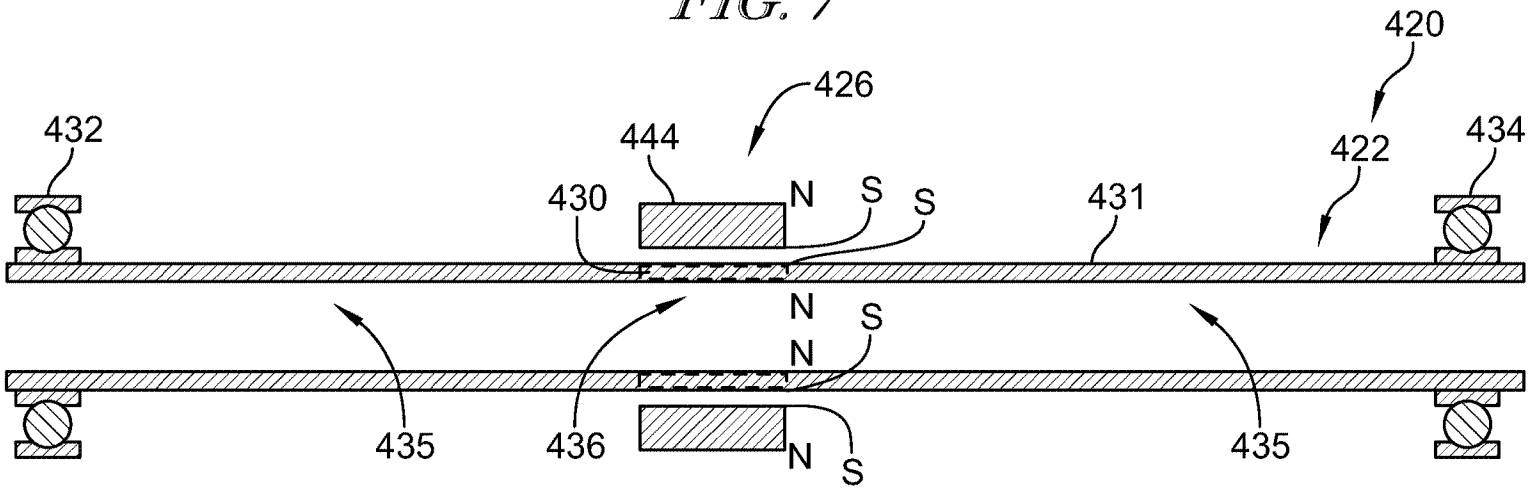
FIG. 8 is a cross-sectional side view of another shaft assembly adapted for us with the gas turbine engine of FIG. 1 showing a shaft coupled to a plurality of shaft magnets and a magnetic mode control unit that includes a plurality of static magnets that are arranged to be opposite the polarity of the plurality of shaft magnets so that a repelling force is exerted on the plurality of shaft magnets.

Another embodiment of a shaft assembly 420 in accordance with the present disclosure is shown in FIG. 8. The shaft assembly 420 is substantially similar to the shaft assembly 20 shown in FIGS. 1-4 and described herein. Accordingly, similar reference numbers in the 400 series indicate features that are common between the shaft assembly 420 and the shaft assembly 20. The description of the shaft assembly 20 is incorporated by reference to apply to the shaft assembly 420, except in instances when it conflicts with the specific description and the drawings of the shaft assembly 420.

The shaft assembly 420 includes a shaft unit 422 and a passive magnetic mode control unit 426 as shown in FIG. 8. The passive magnetic mode control unit 426 controls vibrations and radial deflections in the shaft unit 422. The passive magnetic mode control unit 426 is located radially outward of the shaft unit 422. The shaft unit 422 includes a shaft 431, a forward bearing 432, and an aft bearing 434 as shown in FIG. 8. An unsupported region 435 of the shaft 431 is located axially between the forward bearing 432 and the aft bearing 434.

The passive magnetic mode control unit 426 includes a first magnet 430 and a second magnet 444 that is statically coupled to the gas turbine engine 10. The first magnet 430 is coupled to the shaft 431 along a portion of the unsupported region 435. In the illustrative embodiment in FIG. 8, the first magnet 430 is embedded in the shaft 431 and located at the anti-node 436 for the first mode of the shaft 431. The second magnet 444 is axially aligned with the first magnet 430. The first magnet 430 is arranged so that the polarity of the first magnet 430 is opposite the polarity of the second magnet 444 when each of the first and second magnets 430, 444 are adjacent to each other in the shaft assembly 420.

In the illustrative embodiment in FIG. 8, the north poles of each of the first and second magnets 430, 444 are arranged to face one another. In another embodiment, the south poles of each the first and second magnets 430, 444 may face one another. The arrangement of the polarities of each of the first and second magnets 430, 444 create a repelling force between the magnets 430, 444. The passive magnetic mode control unit 426 passively suppresses radial deflections and vibrations in the shaft 431 when the shaft 431 rotates at a mode speed.

Gas turbine engines, electric machines and many other types of devices use shafts to transmit torque. A challenge of shaft and bearing design may be managing the vibrational modes of the shaft 31 relative to the operating speed regime. In a gas turbine engine 10, it may be possible to operate a mainline shaft 31 "super-critical" which means that the normal operating speed is above the first mode, but below the second and subsequent modes of the shaft 31. This may be accomplished in conventional engines by using squeeze film dampers on the bearings 32, 34 which provide system damping during the acceleration from sub-critical to super-critical speeds. Squeeze film dampers may be insufficient for greatly excited resonances, extended durations around a critical speed and/or may not be sufficient for damping more than one system mode.

The magnetic mode control unit 26 is placed at the anti-nodes 36, 38 of the desired mode to be suppressed and can be used with conventional bearings. An axial cross-section of the invention is shown in FIG. 3. As the shaft 31 begins to displace in a given mode the mode controller 26 will exert a force opposite to the motion of the anti-node of mode of the shaft 31. This may be accomplished by having multiple magnetic poles distributed circumferentially around the shaft as shown in FIG. 2. FIGS. 3 and 4 shows an embodiment for suppressing the first mode, while FIG. 5 shows an embodiment for suppressing the second mode. When the operating speed of the shaft 31 approaches the frequency of the first mode, the controller 52 will activate and put forces into the shaft 31 opposite its deflection. This may effectively turn the anti-node 36 of the shaft 31 into a node forcing it to vibrate in the second mode which will have a higher frequency, therefore allowing for more stable operations.

The advantages of the present disclosure are that the magnetic mode control unit 26 may suppress larger loads than squeeze film dampers. The magnetic mode control unit 26 may also be configured to act on different modes of the shaft 31, and the magnetic mode control unit 26 can be turned off when in an operating regime outside of a mode of the shaft 31 to conserve power. Adding additional bearings at the same location as the magnetic mode control unit 26 could have drawbacks such as using active lubrication continuously during operation and it may generate heat and use secondary systems for sealing. An advantage of the present disclosure over just using magnetic bearings is that the forces for mode suppression may be significantly less than those which a bearing must tolerate, which may enable the present devices to be more compact.

Another embodiment may use a permanent-magnet passive solution as shown in FIG. 8. In this embodiment, permanent magnets 430 are embedded in the shaft 431 and separate permanent magnets 444 are installed in a housing surrounding the shaft 431. The polarity of the magnets 430, 444 will be arranged such that the polarity of the face of the static magnets 444 facing the shaft 431 will match the polarity of the rotating magnets 430 facing the static structure. This will then create a repulsive force. The static magnets 444 will be placed a specific calculated distance away from the rotating magnets 430. Thus, as the shaft 431 begins to vibrate in the given mode it will displace toward the static magnets 444. The relative flux density will increase and therefore so will the force opposing the motion.

To improve efficiency with a minimum weight, gas turbine engines often have multiple spools or shafts 31, 41 that operate at different speeds. Some engines have 3 spools including a low-pressure, intermediate-pressure and high-pressure spool, while other engines have 2 spools including a low-pressure and high-pressure spools. All of these engines feature concentric shafts 31, 41 to transfer torque from the turbine 18 at the back of the engine to the compressor 14, gearbox, or shaft at the front of the engine.

During the initial sizing of an engine 10 the outer diameter of each of the shafts 31, 41 contribute to the overall architecture of the engine 10. A larger shaft 31 outer diameter may enable carrying the more torque with less weight, while simultaneously increasing the stiffness of the shaft which may help avoid resonances within the operating range of the engine 10. Smaller diameter shaft 31 may reduce the minimum bore diameters of each of the compressor 14 and turbine 18 wheels. A lower bore diameter may result in a lighter wheel for equivalent carrying capacity.

The shafts 31, 41 are sized to carry torque and to avoid resonances within the engine operating range that can lead to vibration and or contact between the two shafts 31, 41. The shafts 31, 41 may run at different speeds and/or in different directions. Shaft deflections may translate through to the components connected to them which may result in the blade tips of compressor 14 or turbine 18 rubbing against the casing which will open up tip clearances and reduce engine efficiency. In the illustrative embodiments, the inner shaft 31 is axially longer and has smaller diameter which will lower its fundamental frequency. In conventional engines, the first vibrational mode of the shaft is designed to be below the normal idle running range while having the subsequent modes above the normal running range. During start-up conditions, however, the shaft transits through this first mode crossing, so squeeze film dampers have been used in conventional engines to reduce the magnitude of transmitted vibration during this startup condition.

With increase electrification in gas turbine engines, hybrid architectures use electric motors integrated within the gas turbine engine to either extract energy or provide power depending on the condition or state. This enables an increased operating speed range on some of the spools of the gas turbine, such as during an electric-only taxi. This may impact the traditional practice of not operating near the vibrational mode speeds or regions for a shaft.

According to an aspect of the present disclosure, a magnetic mode control device 26 acts to control the amount of deflection on an interior shaft 31 of a concentric shaft system 20 without affecting the outermost shaft 24. An advantage of this arrangement may be that longer interior shafts 31 that are simply supported can be designed successfully. A further advantage this arrangement may be to reduce clearances between the shafts 31, 41. A reduction in clearances may enable the inner shaft 31 to have a larger diameter to be capable of carrying more torque, or to be made thinner and lighter for carrying the same torque. The reduction in clearances between the shafts 31, 41 may also allow for the outer shaft 41 to have a smaller diameter and reduced weight. In the illustrative embodiment in FIGS. 2 and 3, permanent magnets 30 have been embedded into the inner shaft 31 upon which the electromagnetic mode control device 26 will act.

Squeeze film dampers may allow a small amount of radial deflection which may contribute to blade tip rubbing and loss of engine efficiency. The magnetic mode control device 26 may allow for a rotor assembly to not use squeeze film dampers and be directly mounted into the gas turbine engine 10 static structure. This configuration may allow less radial deflection of the rotor assembly 20, reduce blade tip rubbing, and improve the efficiency of the gas turbine engine 10. In another embodiment, squeeze film dampers may be used in combination with the magnetic mode control unit 26 so that the magnetic mode control unit 26 reduces radial deflections of the rotor assembly 20 to reduce tip clearances and improve engine efficiency.

The shaft control device 26 is mounted on the static structure outside the outer shaft 41, but is able to act upon the inner shaft 31 via the magnetic field it produces. Interaction with the outermost shaft 41 may be avoided by either selecting a non-ferritic material such as titanium, stainless steel, or carbon fiber. It may be possible to not embed permanent magnets 30 in the inner shaft 31 if it is made of a ferritic material upon which the electromagnetic mode controller 26 can act. This may avoid complexity in holding onto the magnets 30. This arrangement could act as a motor/generator.

In a further embodiment, permanent ring magnets 230, 244 may be embedded in the inner and outer shafts 231, 241 with opposing polarity such that as the inner shaft 231 deflects toward the outershaft 241 the magnetic force will push harder on the inner shaft 231 back into its position—effectively transferring some of the energy of vibration from the inner shaft 231 to the outer shaft 241 which may be more capable of handling it. This may work even if the shafts 231, 241 are rotating at different speeds or in different directions since the force will be due to the magnetic flux lines of the permanent magnets 230, 244 which may not be changing with rotation of the shaft. FIG. 6 shows two concentric shafts, but in another embodiment, two or more concentric shafts may be used. In another embodiment, the magnetic flux from the magnets 230, 244 may target the vibrations and deflections in the outer shaft 241.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A shaft assembly for use with a turbine engine, the shaft assembly comprising a first shaft unit that includes a first shaft that extends along an axis and configured to rotate about the axis, a first forward bearing configured to support the first shaft, and a first aft bearing configured to support the first shaft and spaced apart axially from the first forward bearing relative to the axis, a second shaft unit that includes a second shaft arranged circumferentially about the first shaft and configured to rotate about the axis relative to the first shaft, a second forward bearing configured to support the second shaft, and a second aft bearing configured to support the second shaft and spaced apart axially from the second forward bearing relative to the axis, a magnetic mode control unit configured to control deflection of the first shaft caused by natural frequency vibration of the first shaft during rotation of the first shaft, the magnetic mode control unit including a first magnet coupled with the first shaft for rotation therewith and a second magnet, the first magnet located axially between the first forward bearing and the first aft bearing, the second magnet being an electromagnet, and the second magnet located radially outward of the first shaft and aligned axially with the first magnet to apply a magnetic force to the first magnet during rotation of the first shaft and reduce deflection of the first shaft, and a controller connected with the electromagnet and configured to power the electromagnet in response to the first shaft rotating at a speed greater than a first threshold value, and wherein the controller is configured to block power to the electromagnet in response to the first shaft rotating at a speed greater than a second threshold value.

2. The shaft assembly of claim 1, wherein the first magnet is located axially at an anti-node of a first order vibrational mode of the first shaft.

3. The shaft assembly of claim 1, wherein the first magnet is located axially at an anti-node of a second order vibrational mode of the first shaft.

4. The shaft assembly of claim 1, wherein the second magnet is located radially outward of the second shaft.

5. The shaft assembly of claim 4, wherein the entire second shaft is made of non-ferritic material so that the second magnet is configured to apply the magnetic force to the first shaft without applying the magnetic force to the second shaft.

6. A shaft assembly for use with a turbine engine, the shaft assembly comprising a first shaft unit that includes a first shaft that extends along an axis and configured to rotate about the axis, a first forward bearing configured to support the first shaft, and a first aft bearing spaced apart axially from the first forward bearing relative to the axis and configured to support the first shaft, a magnetic mode control unit that includes a first magnet located radially outward of the first shaft and located axially between the first forward bearing and the second forward bearing, the magnetic mode control unit configured to apply a magnetic force to the first shaft, wherein the first magnet is an electromagnet, and a controller connected with the first magnet and configured to power the first magnet in response to the first shaft rotating at a speed greater than a first threshold value and configured to block power to the first magnet in response to the first shaft rotating at a speed greater than a second threshold value, the second threshold value being greater than the first threshold value.

7. The shaft assembly of claim 6, wherein the first shaft comprises at least one of Ferris material, a permanent magnet, and an electromagnet axially aligned with the first magnet.

8. The shaft assembly of claim 6, further comprising a second shaft unit that includes a second shaft arranged circumferentially about the first shaft and configured to rotate about the axis relative to the first shaft, a second forward bearing configured to support the second shaft, and a second aft bearing configured to support the second shaft and spaced apart axially from the second forward bearing relative to the axis.

9. The shaft assembly of claim 8, wherein the first magnet is located radially outward of the second shaft.

10. The shaft assembly of claim 8, wherein the entire second shaft is made of a non-ferritic material.

11. The shaft assembly of claim 8, wherein the entire second shaft is formed from a single material with a low magnetic permeability.

12. A method of operating a shaft assembly for a turbine engine, the method comprising arranging a first shaft radially inward of a second shaft, the first and second shafts extend along an axis and rotate around the axis, arranging a magnetic mode control unit radially outward of the first shaft, rotating the first shaft at a first speed that corresponds to a first mode of the first shaft, energizing the magnetic mode control unit to exert forces on the first shaft to reduce radial deflections of the first shaft, rotating the first shaft at a second speed higher than the first speed, and configuring the magnetic mode control unit to de-engerize in response to the first shaft rotating at the second speed.

13. The method of claim 12, wherein the first shaft includes magnets coupled therewith and located an anti-node location along the first shaft.

14. The method of claim 12, wherein the first shaft is made from ferrous material and the second shaft is made from non-ferrous material.

15. The method of claim 12, wherein the magnetic mode control unit is axially aligned to the anti-node locations along the axial length of the first shaft.

* * * * *